US006371835B1

(12) United States Patent
Flisram et al.

(10) Patent No.: US 6,371,835 B1
(45) Date of Patent: Apr. 16, 2002

(54) OFF-LINE HONING OF SLICER BLADES

(75) Inventors: Dennis G. Flisram, Hancock; Terry L. Holmes, DeForest, both of WI (US)

(73) Assignee: Kraft Foods, Inc., Northfield, IL (US)

( * ) Notice: Subject to any disclaimer, the term of this patent is extended or adjusted under 35 U.S.C. 154(b) by 0 days.

(21) Appl. No.: 09/471,692

(22) Filed: Dec. 23, 1999

(51) Int. Cl.[7] ..... B24B 7/19

(52) U.S. Cl. ..... 451/48; 451/44; 451/45; 451/370

(58) Field of Search ..... 451/48, 44, 45, 451/370

(56) References Cited

U.S. PATENT DOCUMENTS

| | | | |
|---|---|---|---|
| 1,914,879 A | | 6/1933 | Bennett |
| 3,024,578 A | | 3/1962 | Mushkin |
| 4,030,249 A | | 6/1977 | Kochemidov et al. |
| 4,186,529 A | | 2/1980 | Huffman |
| 5,097,630 A | | 3/1992 | Maeda et al. |
| 5,117,590 A | | 6/1992 | Kudo et al. |
| 5,209,150 A | | 5/1993 | Arconada Arconada |
| 5,514,025 A | * | 5/1996 | Hasegawa et al. |
| 5,609,512 A | | 3/1997 | Holmes et al. |
| 5,613,894 A | | 3/1997 | Delle Vedove |

* cited by examiner

*Primary Examiner*—Timothy V. Eley
*Assistant Examiner*—Willie Berry, Jr.
(74) *Attorney, Agent, or Firm*—Cook, Alex, McFarron, Manzo, Cummings & Mehler, Ltd.

(57) ABSTRACT

An apparatus and method for honing, sharpening or grinding a curved peripheral cutting surface of a slicer blade are provided. Included is the use of one of a set of interchangeable cams that generally follows the curved shape of the blade cutting surface, whether same has a constant radius or varying radii. The honing is accomplished off-line of the slicer equipment, and the movement of two honing or grinding wheels is closely controlled so as to provide honed or ground cutting edges which are of substantially uniform width throughout their respective peripheries. The two honing or grinding wheels operate independently of each other on opposing edges of the blade, a large blade load area is provided therebetween, precision gib adjustments are provided between the wheel and the cam follower, and a single tool is needed to make adjustments of the apparatus.

21 Claims, 7 Drawing Sheets

OFF-LINE HONING OF SLICER BLADES

BACKGROUND AND DESCRIPTION OF THE INVENTION

The present invention generally relates to honing of a variety of cutting devices by which components such as slicer blades are sharpened, honed or ground along their respective cutting edges. The invention is particularly well-suited for honing, grinding and/or sharpening blades for slicing food products such as large sticks, chubs, loaves or pieces of meat, luncheon meat, cheese and the like. These slicing blades typically have a curved cutting surface or edge portion along all or a substantial part of the periphery of the slicer blade. The invention includes use of a cam member that has a curved pathway at least a portion of which emulates the profile or peripheral shape of the slicing edge of the blade. At least two totally independent sliding honing spindle assemblies are associated with cam followers which engage and follow the camming surface of the cam member. Rotating honing wheels of these honing spindle assemblies closely follow the peripheral edge portion of the blade to effect the honing action in a uniform and accurate manner. The invention also minimizes the number of tools needed to make adjustments to the device.

Slicing equipment for foods and the like are in use within the food processing industry and in other situations when elongated products need to be severed into thin slices. This is especially the case for food processing plants wherein finished products such as sliced luncheon meats, sliced bacon, sliced meat cuts, sliced cheese and the like are processed through a large industrial-scale slicer. In a typical operation, these slices are then packaged and distributed for retail sale as convenient ready-to-sell units. Commercial slicer equipment that is used for slicing and sometimes also stacking and weighing the slices are or have been available from well-known manufacturers such as Cashin, Anco, Formax, Great Lakes and Thurne. Each manufacturer generally uses a blade or blades of differing shape and/or sizing. The blades can have peripheral shapes which are circular, involute, spiral, and the like, each of which has a curved surface of constant radius or varying radii along the periphery of the cutting surface. Each blade is somewhat large and has substantial area that is at least nominally flat.

Some slicer equipment units provide honing devices attached to the slicer itself. This approach is taken in order to afford an apparent advantage of achieving honing through an on-line approach which avoids the need to remove the large blade from the slicer in order to hone or sharpen it. However, this on-line approach has disadvantages which often outweigh this advantage. When honing or sharpening on-line, the resultant grinding dust or particles will often be deposited at locations which could find their way into the food product. Accordingly, it is essential to totally sanitize entire areas of the slicing equipment in addition to cleaning of the blade itself. Furthermore, the slicer, and in many cases a production line of which it is but one component, must be shut down during the entire course of the sharpening and clean-up operations.

Many of these disadvantages are addressed by Holmes et al U.S. Pat. No. 5,609,512, incorporated by reference hereinto. The apparatus of this patent has been found to require relatively long set up time, is somewhat inadequate in its control over blade edge parameters, and is limited in being able to accommodate some larger blades. Also, precision adjustment is lacking, and multiple tools (typically four) are needed to make adjustments.

The present invention provides a honing apparatus that is totally removed from the large slicing equipment. By this off-line approach, the slicing equipment and food processing line of which it may be a component need to be shut down for only the time that is required to remove the dull blade and replace it with another, previously sharpened or honed or ground blade.

In addition, the set up time for installing the blade within the honer is exceptionally short because, for example, the blade fits directly onto its support with little or no obstruction from the honing apparatus components. Removal of the sharpened blade likewise is carried out in an advantageously short time. Also addressed by the present off-line honer is its ability to accommodate very large sized blades.

Most slicer blades have ground cutting surfaces on both the top and the bottom edges of the peripheral cutting portion of the blade. Various honing or sharpening approaches in the past have proceeded with the honing of one ground edge at a time. This typically causes the formation of a burr on the other surface. Then, when the other surface is honed, a burr is formed on the first surface. This leads to alternative honing (after the first honing step) through burrs formed during honing of an opposite surface, typically leaving a burr on the cutting surface opposite of the last-honed surface. In the units shown in U.S. Pat. No. 5,609,512, there are two closely spaced honers which generally simultaneously engage the blade at somewhat opposing surfaces. This is thus characterized by substantially non-independent honing units which operate on approximately the same portion of the blade at any given time of the honing operation.

Another difficulty which is often encountered in sharpening large blades such as the large slicer blades for commercial meat slicers is the difficulty in maintaining flatness of blades having such an extensive peripheral edge. In this regard, it is important that the blade be as flat as possible during honing, and when needed, accommodate blade body curvatures or cavities while maintaining a flat peripheral edge portion. If not, the honed ground surface typically will exhibit a non-uniform width along the peripheral extent of the cutting edge of the blade. Another challenge for off-line honers is having them arranged so as to be suitable for use with any one of the variety of differently sized and/or shaped blades that are required for the various slicers in commercial use. Each such blade has a curved periphery, but curve size and shape varies from blade to blade. This difficulty is particularly evident when a processing plant utilizes slicers of different manufacturers and/or of different sizes.

In summary, the present invention addresses each of these problems or difficulties. The invention provides for off-line honing of slicer blades. The apparatus of the invention includes a cam member having a curved pathway or camming surface that is shaped to follow a curved cutting surface of a particular type of cutting blade. A variety of such cam members can be provided, each one being sized and shaped for a particular style and size of slicer blade. Various such blades and cam members are interchangeably mounted on a rotation assembly that rotates a properly sized and shaped cam member and its corresponding cutter blade together. During such rotation, a cam follower of each of two honing spindle assemblies engages the cam member in order to thereby assist in directing a rotating honing wheel or the like along the blade surface to be honed, sharpened or ground. A suitable biasing assembly ensures contact is maintained between the cam follower and the cam member. In this way, each rotating honing wheel or the like closely follows the curvature of the particular blade being sharpened. An angularly offset honing spindle assembly is provided to hone the primary angle profile of the blade, the spindle assembly being positioned at one location of the apparatus. A generally vertical honing spindle assembly is provided to hone the top flat land of the blade at different and far removed location along the blade, this spindle assembly being at a generally radially opposite location of the apparatus. This independent honer approach provides a finished honed blade that is deburred, while also gaining the other advantages of the invention.

It is a general object of the present invention to provide for improved off-line honing of slicer blades.

Another object of the present invention is to provide an improved apparatus and method for off-line honing which feature an enlarged loading area, exhibits precision gib adjustments for primary and deburring stone adjustments, while also requiring only a single tool to make adjustments to the honer unit.

Another object of this invention is to provide an improved off-line honing apparatus and method which reduces downtime and minimizes sanitization procedures associated with maintaining a sharp and properly honed blade on commercial slicers.

Another object of the present invention is to provide improved honing of slicer blades that minimizes the formation of burrs while using totally independent primary and deburring slide assemblies.

Another object of this invention is to provide an improved apparatus and method for attaining superior sharpness levels on large slicer blades.

Another object of the present invention is to provide an improved honing apparatus and method which maintains close tolerances with respect to blade flatness and particularly cutting edge flatness, while forming honed or ground cutting edge surfaces which are of substantially uniform width throughout their respective peripheral lengths.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
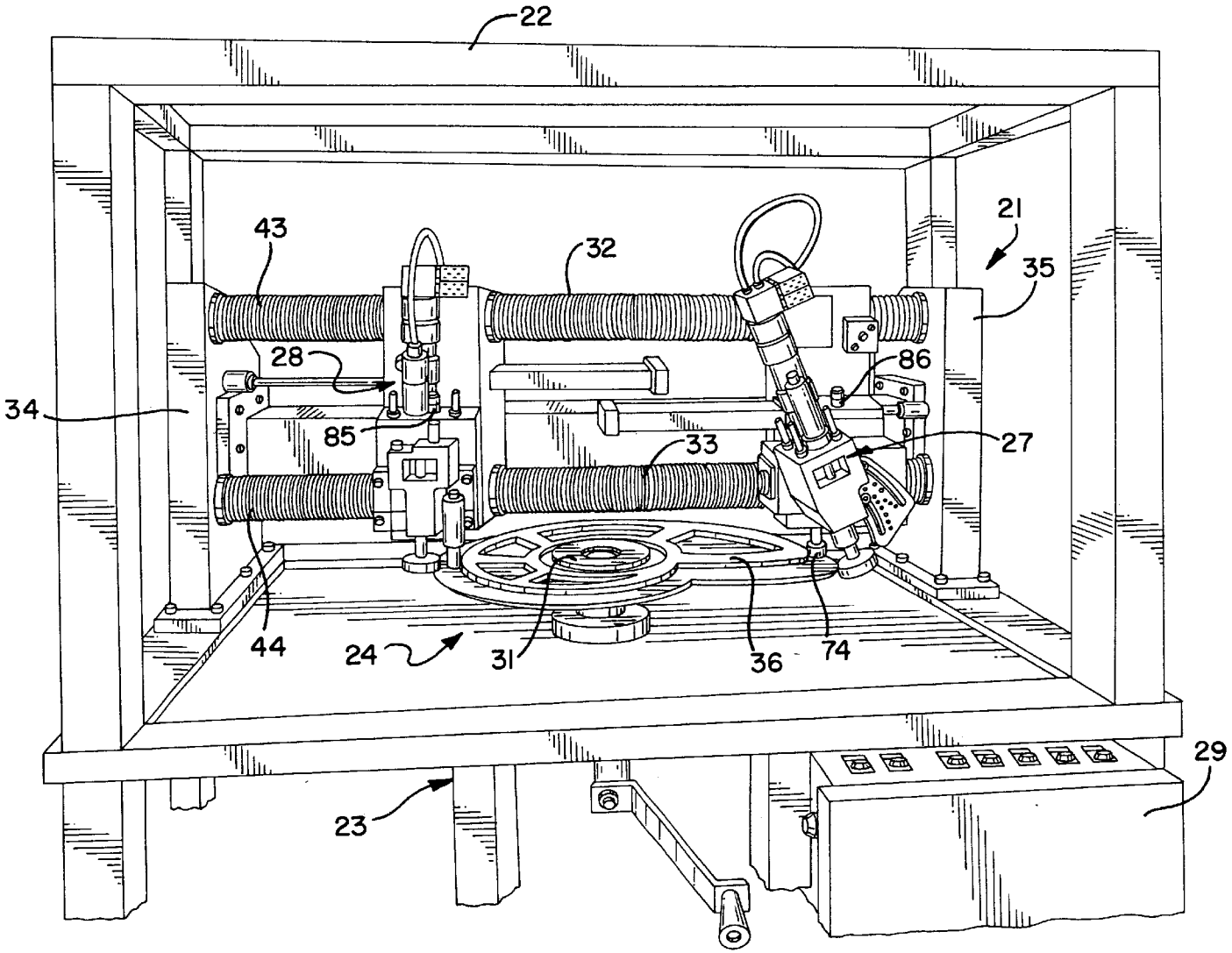
FIG. 1 is a perspective view of a honing apparatus in accordance with the present invention.

An off-line honer, generally designated at 21 in FIG. 1, is illustrated within a shroud or closeable cabinet, generally designated at 22, resting on a suitable support structure, generally designated at 23. This overall arrangement is illustrative of other possible structures for supporting and enclosing the off-line honer assembly. The use of an enclosure cabinet 22 is useful in avoiding undesirable dissipation of honing debris, including ground particles and lubricating oil which will be prevented from leaving the cabinet during honing procedures, as desired. Preferably, hinged panels are included on the enclosure cabinet to allow access to the honer components.

A turntable assembly, generally designated at 24, is provided for supporting and rotating the blade to be honed, ground or sharpened. It is driven by a motor assembly, generally designated at 25. Turntable assembly 25 includes a mounting plate 31 which accommodates, supports and holds a selected cam plate 36. Cam plate 36 has a cam surface which provides a path to the slide assembly cam followers to govern honer stone position with respect to the geometry of the particular blade to be honed. An encoder, mounted below the turntable, provides position information to the programmable logic controller within control cabinet 29.

A carriage assembly, generally designated at 26, movably supports two spindle assemblies. One is a primary slide assembly 27 which supports a primary bevel stone motor assembly, this spindle assembly 27 being for honing the primary angle profile of the blade. The other is a deburring slide assembly which supports a deburring stone motor at a fixed vertical position, which spindle assembly 28 is for honing the top land width of the blade. These spindle assemblies are independent of each other in operation along the carriage assembly, and the spindle assemblies are oppositely spaced radially across from each other along the turntable and thus the blade.

By suitable camming mechanisms and control arrangements, the honing component of each spindle assembly closely follows the curvature of the blade being honed, ground or sharpened while it is rotated by operation of the motor assembly. Suitable control equipment, preferably including computer hardware and software programmed to provide desired control outputs for each given style or size of cutter blade, are suitably housed in control cabinet 29. A control panel (not shown) allows the operator to input certain data and functions in order, for example, to select the proper program for the blade to be honed, ground or sharpened.

With further reference to the carriage assembly 26, two parallel elongated Thompson rods 32, 33 are rigidly mounted to the support structure 23 by suitable mounts 34, 35. Slide assemblies 38, 39 are slidably mounted onto both of the elongated rods 32, 33 through ball bushings. Protective accordion covers or boots 43, 44 are preferably included to provide protection from honing debris for the elongated rods 32, 33.

In the illustrated embodiment, these constitute components of a sliding support assembly for the spindle assemblies 27, 28, by virtue of which the spindle assemblies will move, as required by the camming arrangement and/or program for the particular blade being honed, ground or sharpened. The illustrated sliding support assembly supports the primary bevel stone motor assembly at a fixed vertical position and allows the motor to slide horizontally while it follows the contour of the cam plate and thus of the slicer blade.

The primary bevel slide assembly includes a cam follower 74 which rides on the blade cam and positions the stone so that it follows the slicer blade contour. An air cylinder 37, attached between the mount and the end support weldment, forces the slide assembly cam follower 74 to engage the surface 41 of the cam plate 36. With this arrangement of the illustrated sliding support assembly, it will be noted that this assembly will move as a unit and will be responsive to the urgings of the air cylinder 37.

Referring now in greater detail to the honing spindle assemblies, the illustrated embodiment includes two such assemblies. Assembly 27 is shown in the drawings for honing or grinding the primary angle bottom width of the cutting edge of the blade, while the assembly 28 is shown for honing or grinding the top land width of the blade. In the illustrated arrangement, spindle assembly 27 is shown honing or grinding a primary angle on the so-called bottom surface of the peripheral cutting edge of a blade 54, and spindle assembly 28 is shown honing or grinding a so-called top flat land width of the peripheral cutting edge of the blade 54. This is perhaps best shown in FIGS. 6 and 7.

Figure 7:
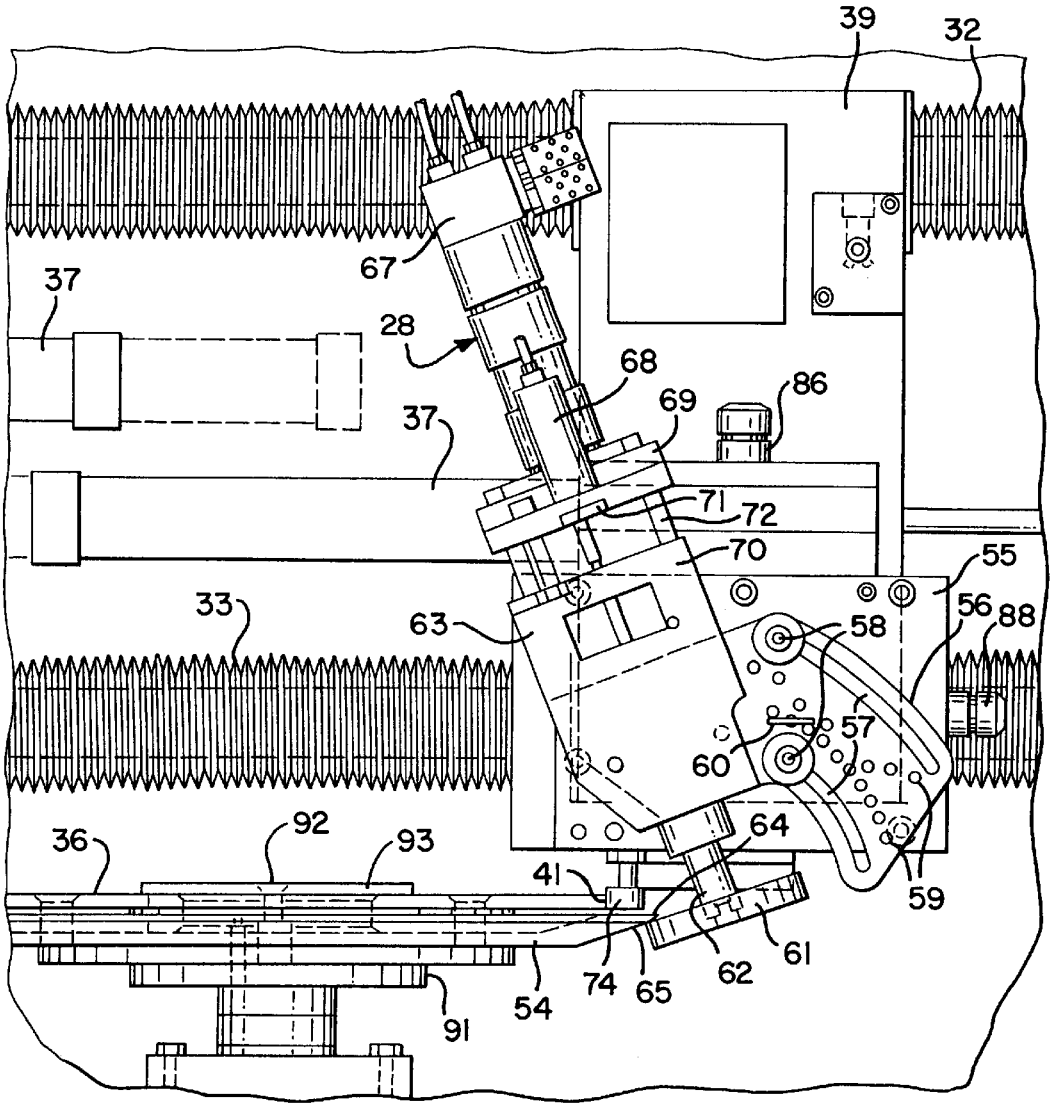
FIG. 7 is an elevational view showing another honing spindle assembly of the illustrated off-line honing apparatus.

Further details of the primary angle spindle assembly 27 are found in FIGS. 1, 3, 5 and 7. A mounting plate 55 or any other suitable arrangement is secured to the sliding support assembly, and the primary angle spindle assembly 27 is secured thereto in an adjustable manner whereby the primary angle honing angle can be varied in accordance with the needs of the particular blade being honed or ground. In this regard, a pivot plate 56 is provided. Included are one or more slots 57 through which tightening bolts 58 pass. The rest of the spindle assembly 27 is rigidly secured to the pivot plate 56. A plurality of marked angle indicator holes 59 are preferably provided in order to designate primary angle values without having to independently measure same during each adjustment of the primary angle which is imparted to the blade 54 by the primary angle spindle assembly 27. For example, FIG. 7 shows the primary angle set at a selected angle by a pull ring 60.

In addition to this angular adjustment, the illustrated spindle assemblies permit axial extension and retraction of the honing member itself. More specifically, each spindle assembly includes a honing or grinding wheel 61 which is suitably mounted to a spindle 62 rotatably mounted within a housing 63 through the use of suitable bearings (not shown). Suitable seals, bushings and spacers and a spindle mounting member to ensure true and low-friction axial rotation of the honing member 61. This rotation is imparted by a suitable arrangement such as the illustrated motor 67.

Movement of the spindle 62 within the housing 63 is effected by an air cylinder 68, a suitable air cylinder in this regarding having a one inch stroke. Air cylinder 68 is secured to a motor adaptor plate 69 through the use, for example, of a cylinder mounting nut 71 and with the guidance of a spindle guide rod 72, which can be mounted to a spindle riser 70 and within a suitable bearing (not shown). Retraction of the rod of the air cylinder 68 will cause the honing member or wheel 61 to move generally outwardly or inwardly, while extension thereof will cause the honing member or wheel to move generally downwardly or outwardly. As discussed in greater detail herein, a cam follower 74 is in operative securement with the spindle assembly 27 and thus with the working face 75 of the honing or grinding wheel 61.

Figure 6:
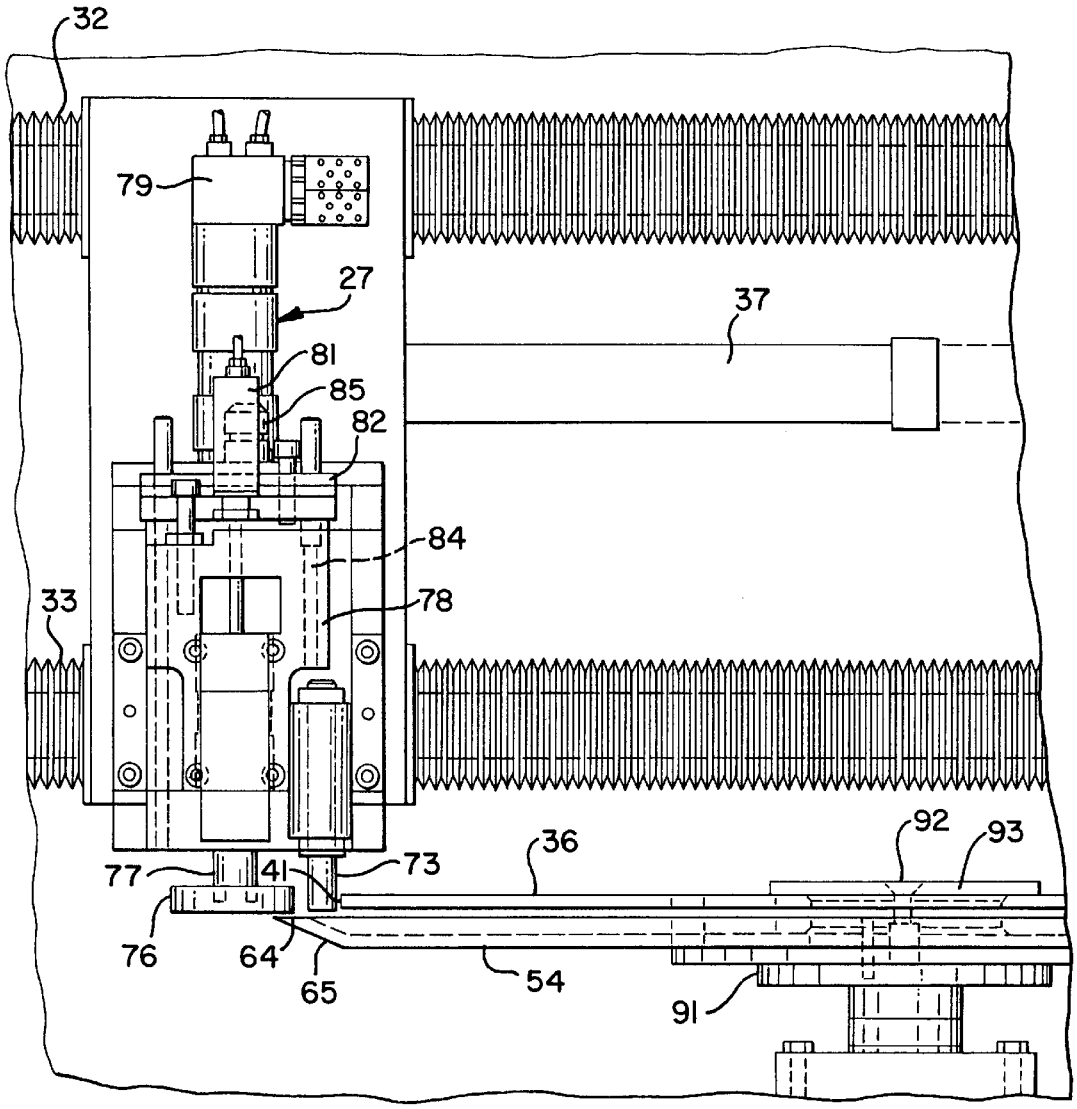
FIG. 6 an elevational view showing a honing spindle assembly of the illustrated apparatus.

FIG. 6 provides further details of the spindle assembly 28 as it is illustrated in the drawings as a deburring spindle assembly. This particular assembly omits the angle adjustment assembly of the spindle assembly 27. It is shown as being mounted in a substantially vertical manner in order to hone, grind or sharpen a flat top portion or top flat land width of the blade 54. It also includes other components of the spindle assembly 27 including a honing or grinding wheel 76, a spindle 77, a housing 78, an air motor 79, an air cylinder 81, a motor adaptor plate 82, and at least one spindle guide rod 84.

Figure 5:
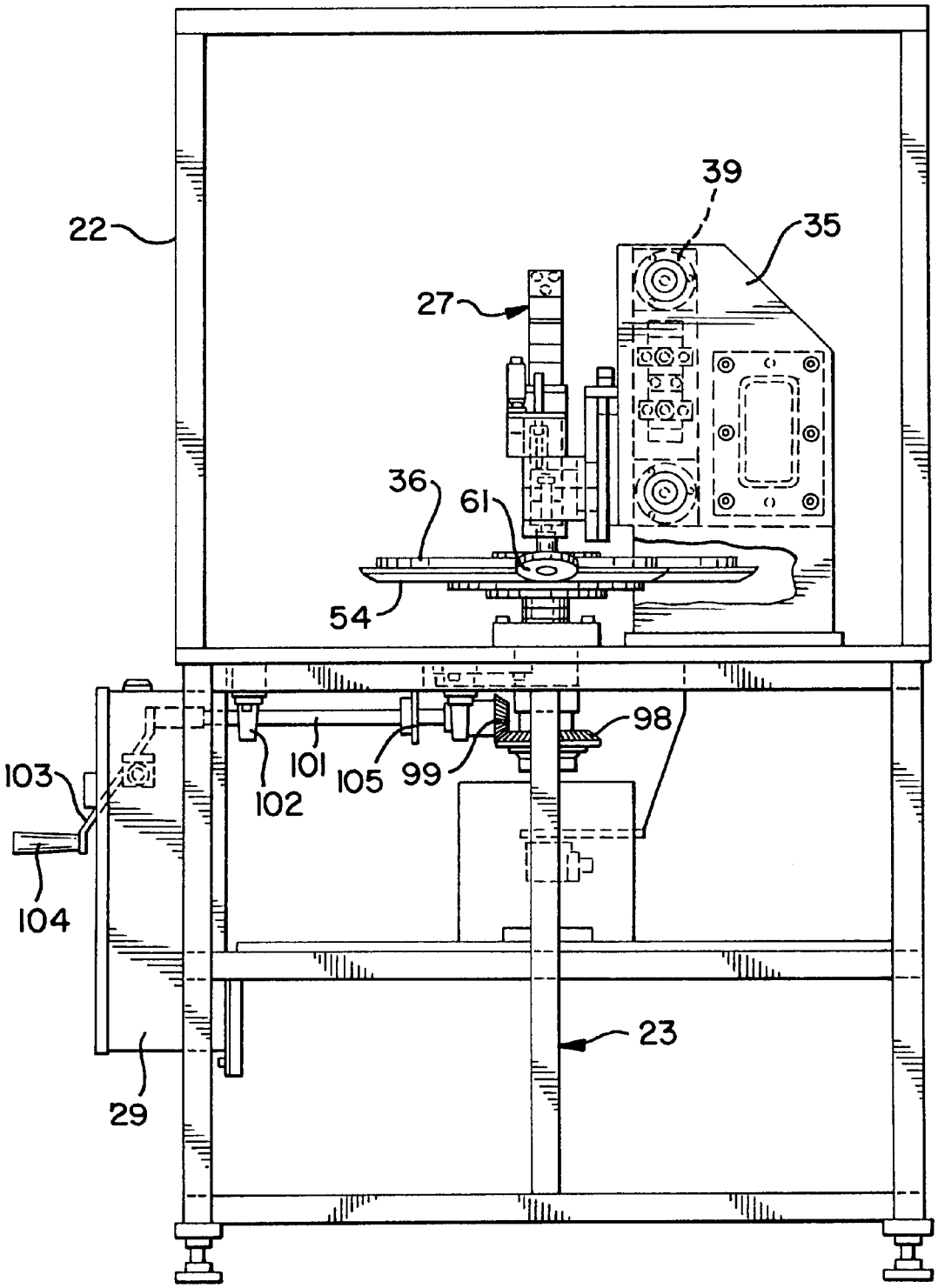
FIG. 5 is a right side view of the illustrated apparatus.

Referring to the turntable assembly 24, it includes a table top or turntable 91. Depending upon the particular blade being honed or ground, a mounting bolt 92 will directly secure a plate clamp 93 or a cam to rotate with the turntable assembly. When the plate clamp approach is used, it clamps down the cam to hold the blade securely and flatly. Turntable assembly 24 is driven by a suitable motor during the honing or grinding procedure. In this regard, an encoder typically is provided. Also shown in FIG. 5 is a manual crank arrangement whereby a proper starting point for the honing or grinding operation can be manually located. Included is a bevel gear 98 and an associated bevel pinion 99. Drive shaft 101 is shown mounted within a pillow block 102, and a crank 103 and handle 104 are mounted for driving engagement with the drive shaft 101 as desired. The motor (not shown) will rotate the drive shaft through a suitable drive arrangement including sprocket 105.

Figure 2:
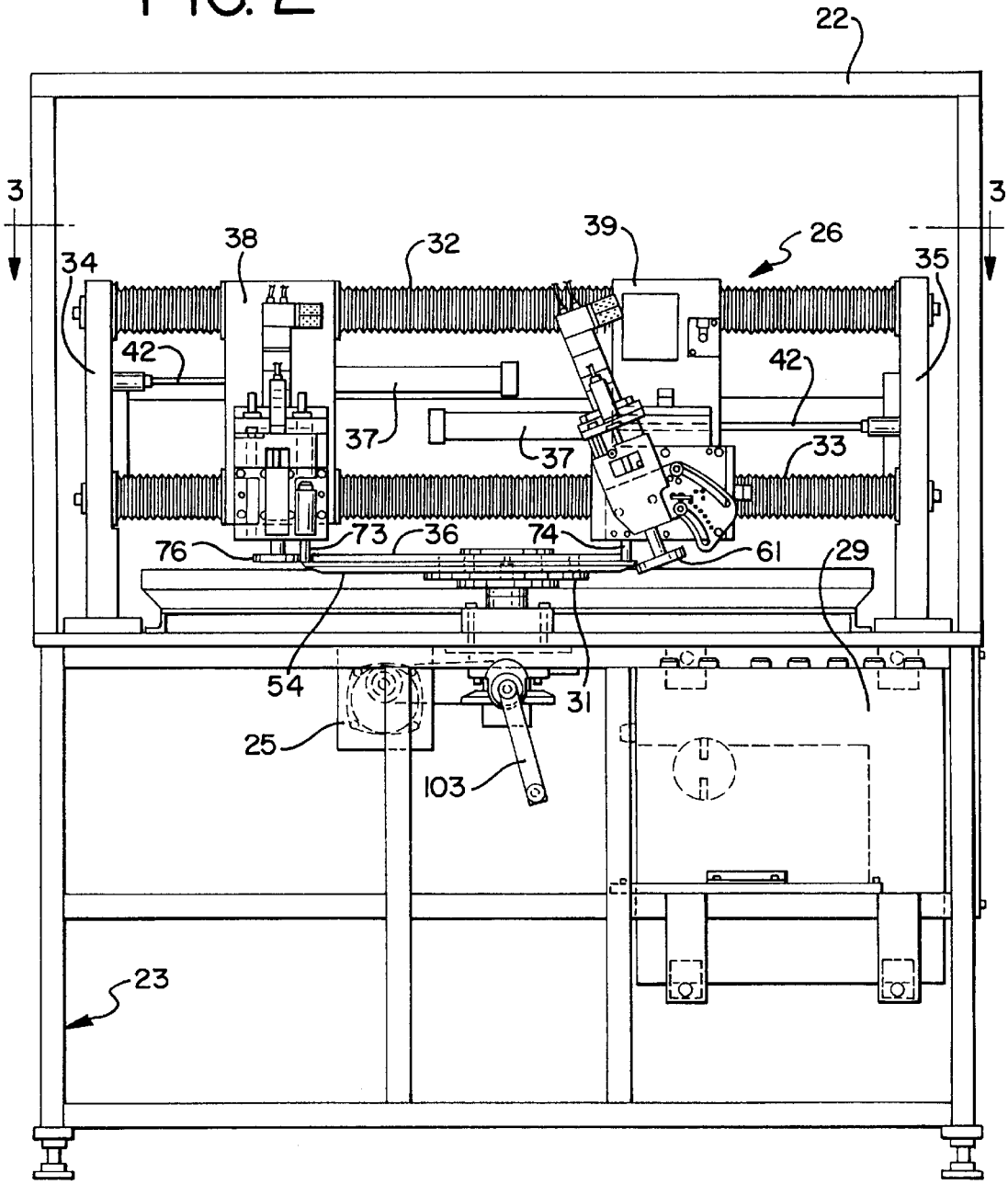
FIG. 2 is an elevational front view of the device illustrated in FIG. 1.
Figure 3:
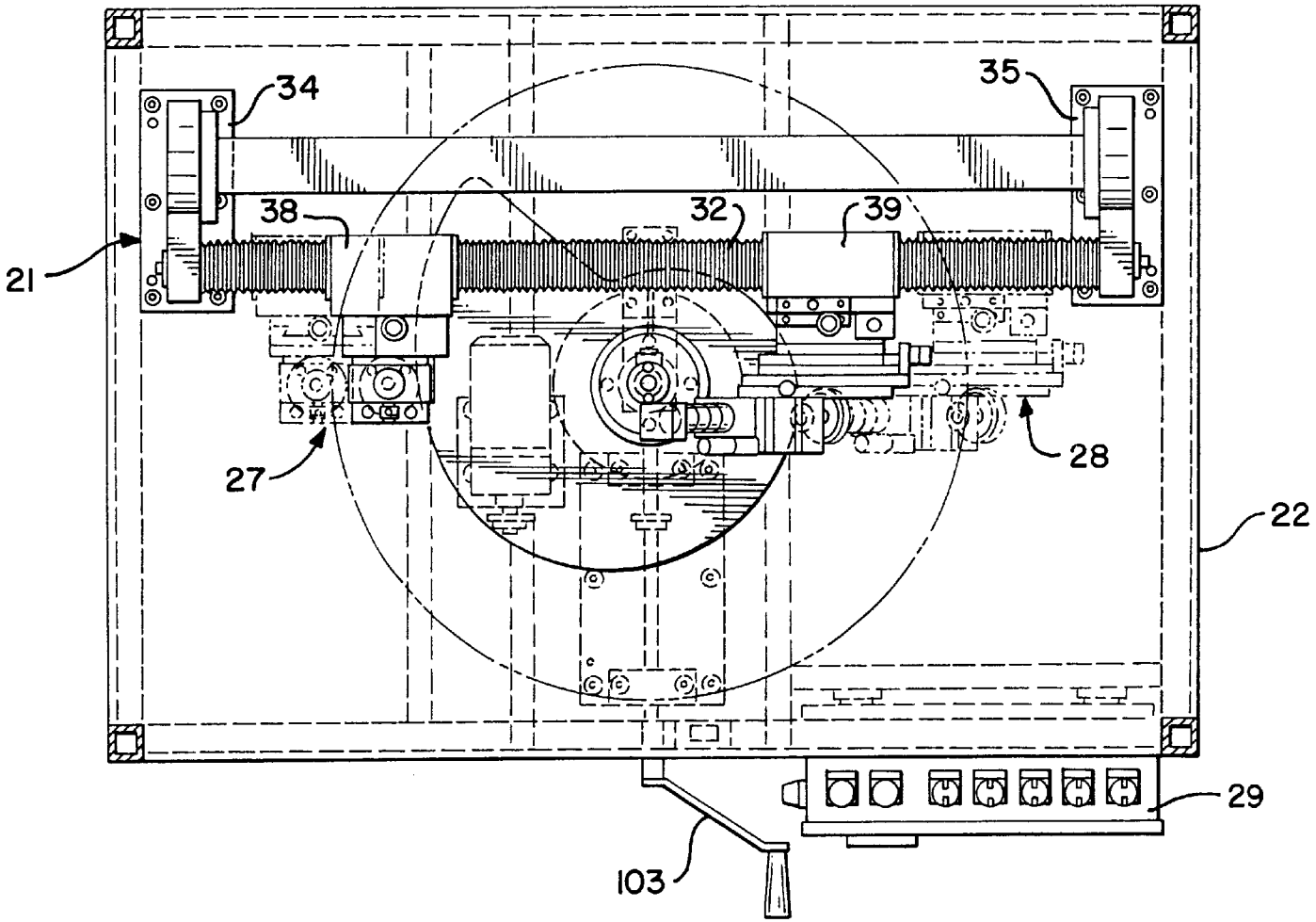
FIG. 3 is a top plan view of the illustrated apparatus.
Figure 4:
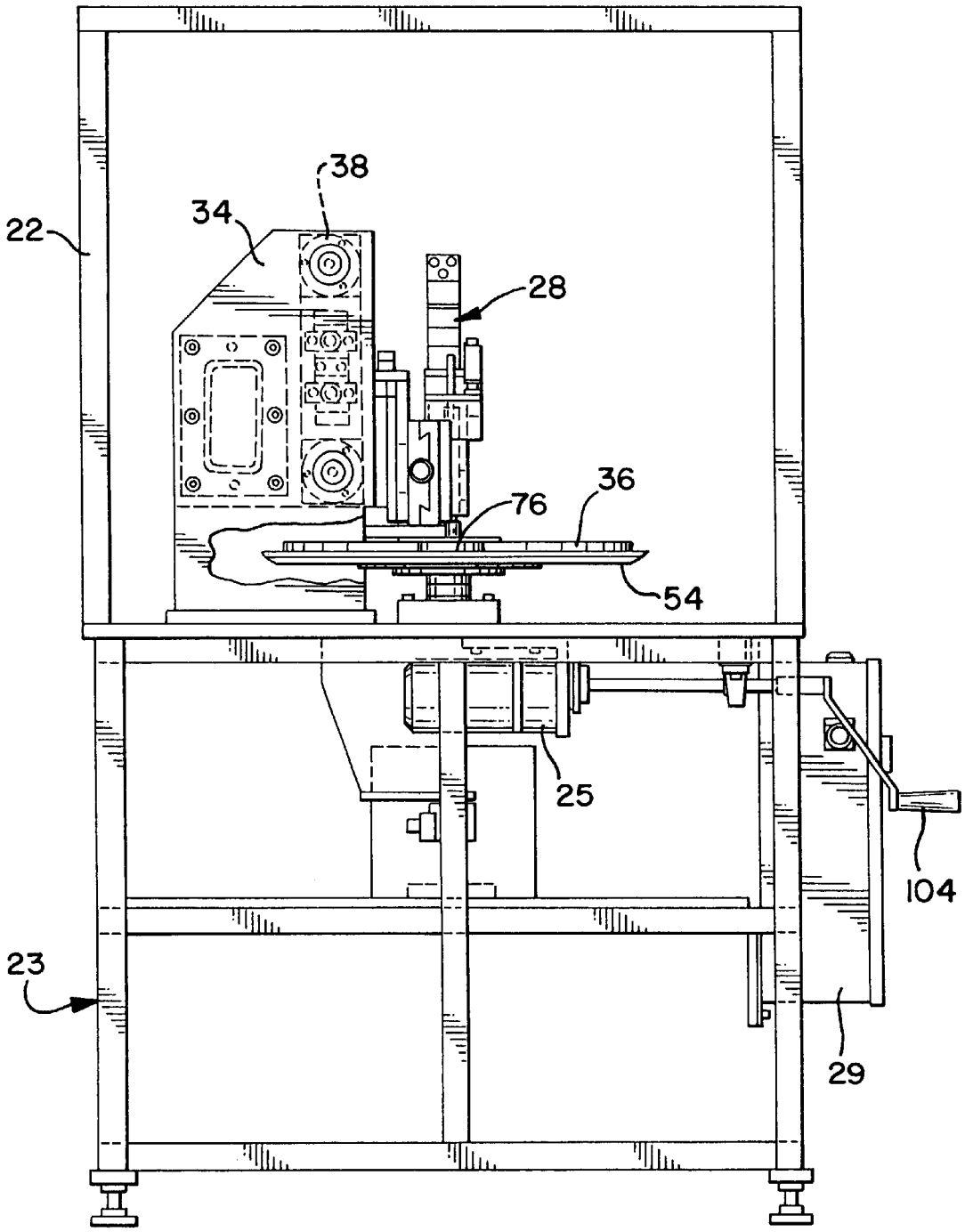
FIG. 4 is a left side view of the illustrated apparatus.

FIGS. 2, 6 and 7 provide further details of the relationship between the cam and cam follower and between the honing wheel and the peripheral edges of the blade being honed or ground. Illustrated blade 54 has a flat top surface or land width 64 which is engaged by the honing or grinding wheel 76. The honing or grinding wheel 61 engages the primary bevel surface 65 of the blade 54 at a location along the blade which is generally radially opposite to the location at which the flat top land width 64 is engaged by the honing wheel 76. Virtually all of any burr formation made in connection with honing of the primary bevel surface will be removed during honing of the top flat surface 64.

The primary angle is the angle defined between the top flat surface 64 and the primary bevel surface 65. It will be appreciated that cam follower 74 and cam follower 73 engage and rotate along cam surface 41 of the cam plate 36; of course, this illustrated cam surface 41 is curved in that it has a curved profile in the horizontal orientation as shown in the drawings.

Air cylinders 37 as previously identified biases the cam followers 73 and 74 onto the cam surface 41. This biasing action will include, at least in the case of a non-circular blade, both extension and retraction of the cylinder rods 42. The extension is due primarily to the hydraulic pressure imparted by the respective cylinder rods by the air cylinders 48, and the retraction is due primarily to the overcoming of that hydraulic pressure when the profile of the cam surface so dictates, such as when it is in a mode of increasing radius length.

A typical control panel and display which can be provided for controlling and monitoring the rotation of the turntable assembly 24 and the extension and retraction of the air cylinders 37 includes a plurality of control keys as well as a display. By activating one or more of the keys, the operator selects one of the pre-programmed control patterns that had been previously entered into memory. For example, the operator could enter a proper code for the particular type of blade being honed, ground or sharpened. In a typical application, the operator will also "zero" the blade to the designated starting point for the program. This can be achieved, for example, by turning the handle 104 and thus the turntable assembly 24 until the blade is at the designated starting point. This can be signaled, for example, by the lighting of a light or by a prompt on the display or the like.

Thereafter, the program, in conjunction with the engagement between the cam followers and cam when appropriate, controls movement of the honing wheels. This movement includes following the profile of all or substantially all of the cutting surface of the blade being honed or ground. In the case of non-circular blades, this movement also will typically include axial extension and retraction of the rotating honing wheel(s) so as to "dock" and "undock" the grinding wheels from the cutting edge being honed or ground.

For example, with particular reference to FIG. 6, the honing wheel 76 of the deburring spindle assembly 28 retracts axially to move out of engagement with the top flat surface 64 at about the same time that the surface 64 ends on a typical involute blade. Conversely, axial extension occurs in order to dock the wheel 76 onto the top flat surface 64 at or substantially at the beginning of the surface on a typical involute blade. For the primary angle spindle assembly 27, reverse movements will generally be required in order to dock and undock.

It will be appreciated that it is of considerable importance that the location of the honing wheels be precisely controlled. Accuracy of honing has been found to be enhanced by implementing precision gib adjustment mechanisms for the primary angle honing and for the deburring operation. A horizontal gib is provided to allow precise adjustment of the stone in relation to the cam follower. Gib controls 85 and 86 are shown in FIG. 1. Further details are illustrated in FIGS. 6 and 7, with gib control 88 being visible in FIG. 7. Each uses technology available for lathes and the like in order to provide micrometer-scale adjustment of the spacing between the respective grinding stones and cam followers 73, 74 respectively.

A typical manner by which the rotation position of the blade can be tracked is through the use of a pulse generator in connection with the motor. For example, the command to dock the honing wheels can occur after a given number of generated pulses beyond the zero setting, and the honing wheels will be undocked after an additional given number of pulses have been generated. The appropriate number of pulses in each instance will be determined according to the pre-programmed specifics for each type of slicer blade.

It will be understood that the embodiments of the present invention which have been described are illustrative of some of the applications of the principles of the present invention. Various modifications may be made by those skilled in the art without departing from the true spirit and scope of the invention.

What is claimed is:

1. A honing apparatus for a slicer blade having a curved cutting surface, comprising:

a cam member having a curved pathway camming surface, at least a substantial portion of which has a shape that is substantially the same as the shape of a curved cutting surface of a preselected slicer blade and has a radial extent that is less than the radial extent of a corresponding location along the curved cutting surface of the preselected slicer blade;

a rotation assembly which rotates said cam member and its corresponding preselected slicer blade together;

two honing spindle assemblies, each spindle assembly having a rotatable honing member and a cam follower operatively connected together such that said rotatable honing member moves in response to movement of said cam follower, and said cam follower engages and follows movement of said curved pathway surface of the cam member in response to said rotation assembly, and said rotatable honing member thereby follows and engages a peripheral edge of said curved cutting of the preselected slicer blade while said honing member is rotating;

one of said honing spindle assemblies being a bevel surface spindle assembly which has a honing surface that defines an acute angle with respect to the peripheral edge of the curved cutting surface of the slicer blade;

another of said honing spindle assemblies has its rotatable honing member with a honing surface that is substantially parallel to a flat peripheral cutting surface of the slicer blade;

a carriage assembly having two parallel Thompson rods which are vertically spaced from each other, each said honing spindle assembly being mounted to said Thompson rods of the carriage assembly;

said one honing spindle assembly is slidably movable along said Thompson rods toward and away from said cam member through a path which remains on one side of said cam member and slicer blade;

said another honing spindle assembly is slidably movable along said Thompson rods toward and away from said cam member through a path which remains on an opposite side of said cam member and slicer blade, said opposite side being generally diametrically opposed along said cam member to said one side of the cam member and slicer blade;

each said honing spindle assembly operates independently upon generally opposing portions of the slicer blade as the cam and slicer blade rotate; and at least one of said honing spindle assemblies includes a horizontal gib which provides precision micrometer adjustment of the distance between said honing member and said cam follower of that spindle assembly.

2. The honing apparatus in accordance with claim 1, further including a mounting member rotatable by said rotation assembly, said mounting member being for mounting the preselected slicer blade having a curved cutting surface to be honed or ground by the honing apparatus.

3. The honing apparatus in accordance with claim 1, wherein said spindle assemblies are spaceable apart from each other by a distance which accommodates any size of commercial slicer blade.

4. The honing apparatus in accordance with claim 1, wherein said one spindle assembly is a primary angle assembly to hone or grind a primary angle along the peripheral cutting edge of the slicer blade, and said other honing spindle assembly is a deburring spindle assembly which generally defines a flat top land width of the slicer blade.

5. The honing apparatus in accordance with claim 1, further including a biasing assembly by which each said spindle assembly is urged toward said cam member and slicing blade such that said cam follower of the spindle assembly is urged into engagement with said cam member, said biasing assembly allowing for movement of said cam follower in opposition to said biasing assembly.

6. The honing apparatus in accordance with claim 5, wherein said biasing assembly includes a fluid cylinder that extends and retracts to maintain the cam follower in camming engagement with said cam member.

7. The honing apparatus in accordance with claim 1, wherein said honing spindle assembly includes a movement assembly by which said rotatable honing member moves into and out of engagement with said curved cutting surface at selected locations along the slicer blade.

8. The honing apparatus in accordance with claim 7, wherein said movement assembly includes a two-way fluid cylinder.

9. The honing apparatus in accordance with claim 7, wherein said movement assembly is associated with a control assembly that is pre-programmed to axially extend and retract said rotatable honing member during relative movement between said cam member and said honing spindle assembly, said pre-programmed axial extend and retract movement being variable by said control assembly depending upon the particular blade being sharpened.

10. The honing apparatus in accordance with claim 1, wherein each of said curved cutting surface and said curved pathway of the camming surface are substantially circular.

11. The honing apparatus in accordance with claim 1, wherein each of said curved cutting surface and said curved pathway of the camming surface are substantially involute.

12. A honing apparatus for a slicer blade having a curved cutting surface, comprising:

a cam member having a curved pathway camming surface, at least a substantial portion of which has a shape that is substantially the same as the shape of a curved cutting surface of a preselected slicer blade and has a radial extent that is less than the radial extent of a corresponding location along the curved cutting surface of the preselected slicer blade;

a rotation assembly which rotates said cam member and its corresponding preselected slicer blade together;

two honing spindle assemblies, each spindle assembly having a rotatable honing member and a cam follower operatively connected together such that said rotatable honing member moves in response to movement of said cam follower, and said cam follower engages and follows movement of said curved pathway surface of the cam member in response to said rotation assembly, and said rotatable honing member thereby follows and engages a peripheral edge of said curved cutting surface of the preselected slicer blade while said honing member is rotating;

one of said honing spindle assemblies being a bevel surface spindle assembly which has a honing surface that defines an acute angle with respect to the peripheral edge of the curved cutting surface of the slicer blade;

another of said honing spindle assemblies has its rotatable honing member with a honing surface that is substantially parallel to a flat peripheral cutting surface of the slicer blade;

a carriage assembly having two parallel Thompson rods which are vertically spaced from each other, each said honing spindle assembly being mounted to said Thompson rods of the carriage assembly;

said one honing spindle assembly is slidably movable along said Thompson rods toward and away from said cam member through a path which remains on one side of said cam member and slicer blade;

said another honing spindle assembly is slidably movable along said Thompson rods toward and away from said cam member through a path which remains on an opposite side of said cam member and slicer blade, said opposite side being generally diametrically opposed along said cam member to said one side of the cam member and slicer blade;

each said honing spindle assembly operates independently upon generally opposing portions of the slicer blade as the cam and slicer blade rotate; and a biasing assembly by which each said spindle assembly is urged toward said cam member and slicing blade such that said cam follower of the spindle assembly is urged into engagement with said cam member, said biasing assembly allowing for movement of said cam follower in opposition to said biasing assembly.

13. The honing apparatus in accordance with claim 12, further including a mounting member rotatable by said rotation assembly, said mounting member being for mounting the preselected slicer blade having a curved cutting surface to be honed or ground by the honing apparatus.

14. The honing apparatus in accordance with claim 12, wherein said spindle assemblies are spaceable apart from each other by a distance which accommodates any size of commercial slicer blade.

15. The honing apparatus in accordance with claim 12, wherein said one spindle assembly is a primary angle assembly to hone or grind a primary angle along the peripheral cutting edge of the slicer blade, and said other honing spindle assembly is a deburring spindle assembly which generally defines a flat top land width of the slicer blade.

16. The honing apparatus in accordance with claim 12, wherein said biasing assembly includes a fluid cylinder that extends and retracts to maintain the cam follower in camming engagement with said cam member.

17. The honing apparatus in accordance with claim 12, wherein said honing spindle assembly includes a movement assembly by which said rotatable honing member moves into and out of engagement with said curved cutting surface at selected locations along the slicer blade.

18. The honing apparatus in accordance with claim 17, wherein said movement assembly includes a two-way fluid cylinder.

19. The honing apparatus in accordance with claim 14, wherein said movement assembly is associated with a control assembly that is pre-programmed to axially extend and retract said rotatable honing member during relative movement between said cam member and said honing spindle assembly, said pre-programmed axial extend and retract movement being variable by said control assembly depending upon the particular blade being sharpened.

20. The honing apparatus in accordance with claim 12, wherein each of said curved cutting surface and said curved pathway of the camming surface are substantially circular.

21. The honing apparatus in accordance with claim 12, wherein each of said curved cutting surface and said curved pathway of the camming surface are substantially involute.

* * * * *

UNITED STATES PATENT AND TRADEMARK OFFICE

CERTIFICATE OF CORRECTION

PATENT NO. : 6,371,835 B1
DATED : April 16, 2002
INVENTOR(S) : Flisram et al.

It is certified that error appears in the above-identified patent and that said Letters Patent is hereby corrected as shown below:

Column 3,
Line 54, after "Fig. 6" insert "is".

Column 4,
Line 53, delete "28," and insert -- 28 --.

Column 5,
Line 44, delete "regarding" and insert -- regard --.

Column 7,
Line 63, after "curved cutting" insert -- surface --.

Column 10,
Line 41, delete "14" and insert -- 17 --.

Signed and Sealed this

Fifth Day of November, 2002

*Attest:*

*Attesting Officer*

JAMES E. ROGAN
*Director of the United States Patent and Trademark Office*